US010272546B2

(12) United States Patent
Li

(10) Patent No.: US 10,272,546 B2
(45) Date of Patent: Apr. 30, 2019

(54) FORCE RELIEVING MECHANISM AND RATCHET CLAMP HAVING FORCE RELIEVING MECHANISM

(71) Applicants: HANGZHOU GREAT STAR TOOLS CO., LTD., Hangzhou (CN); HANGZHOU GREAT STAR INDUSTRIAL CO., LTD., Hangzhou (CN)

(72) Inventor: Yueming Li, Hangzhou (CN)

(73) Assignee: HANGZHOU GREAT STAR TOOLS CO., LTD., Hangzhou (CN)

( * ) Notice: Subject to any disclaimer, the term of this patent is extended or adjusted under 35 U.S.C. 154(b) by 179 days.

(21) Appl. No.: 15/323,389

(22) PCT Filed: Jul. 2, 2014

(86) PCT No.: PCT/CN2014/081484

§ 371 (c)(1),
(2) Date: Dec. 30, 2016

(87) PCT Pub. No.: WO2016/000223

PCT Pub. Date: Jan. 7, 2016

(65) Prior Publication Data

US 2017/0190025 A1 Jul. 6, 2017

(51) Int. Cl.

| | |
|---|---|
| ***B25B 7/14*** | (2006.01) |
| ***B25B 5/06*** | (2006.01) |
| ***B25B 5/04*** | (2006.01) |

(52) U.S. Cl.

CPC ..... *B25B 7/14* (2013.01); *B25B 5/04* (2013.01); *B25B 5/06* (2013.01)

(58) Field of Classification Search

CPC ..... B25B 7/14; B25B 5/04
USPC ..... 81/315
See application file for complete search history.

(56) References Cited

U.S. PATENT DOCUMENTS

| | | | |
|---|---|---|---|
| 4,995,297 | A | 2/1991 | Richards |
| 5,385,072 | A | 1/1995 | Neff |
| 5,408,904 | A | 4/1995 | Neff |
| 6,708,587 | B1 | 3/2004 | Noniewicz et al. |

(Continued)

FOREIGN PATENT DOCUMENTS

| | | | |
|---|---|---|---|
| CN | 1100681 | A | 3/1995 |
| CN | 1923464 | A | 3/2007 |

(Continued)

*Primary Examiner* — Hadi Shakeri
(74) *Attorney, Agent, or Firm* — Haynes and Boone, LLP

(57) ABSTRACT

The present invention discloses a force relieving mechanism and a ratchet clamp having a force relieving mechanism. The force relieving mechanism includes a first ratchet member, a second ratchet member, a locking member, an actuating member and a restoring member. A first clamp arm of the ratchet clamp is fixedly arranged with a first ratchet member having a first set of ratchets, and a second ratchet member having a second set of ratchets is coupled to the second clamp arm. The second ratchet member is provided with a first hole, the locking member passing through the first hole and being rotatable and translationally movable in the first hole. The actuating member applied a first actuation and a second actuation in turn to the locking member so as to cause the second set of ratchets to be detached from the first set of ratchets.

18 Claims, 8 Drawing Sheets

(56) References Cited

U.S. PATENT DOCUMENTS

| | | | | |
|---|---|---|---|---|
| 6,711,789 | B2 * | 3/2004 | Ping | B25B 5/06 24/499 |
| 7,730,810 | B1 * | 6/2010 | Janson | B25B 7/123 81/367 |
| 8,646,160 | B2 * | 2/2014 | Wu | B25B 7/02 29/243.56 |
| 2002/0083803 | A1 * | 7/2002 | Ping | B25B 7/10 81/394 |
| 2004/0031131 | A1 | 2/2004 | Ping | |
| 2006/0162509 | A1 | 7/2006 | Wang | |
| 2010/0304621 | A1 | 12/2010 | Schouten | |

FOREIGN PATENT DOCUMENTS

| | | | |
|---|---|---|---|
| CN | 201015848 | Y | 2/2008 |
| CN | 2507612 | Y | 8/2012 |
| CN | 204094654 | U | 1/2015 |

* cited by examiner

FORCE RELIEVING MECHANISM AND RATCHET CLAMP HAVING FORCE RELIEVING MECHANISM

RELATED APPLICATION

This application claims priority to the PCT application number PCT/CN2014/081484, filed Jul. 2, 2014. The above-identified patent application is hereby incorporated by reference in its entirety.

FIELD OF THE INVENTION

The invention relates to the field of hand tool and, particularly, to a force relieving mechanism and a ratchet clamp having a force relieving mechanism.

DESCRIPTION OF THE PRIOR ART

Hand tools refer to small tools that are gripped by hand, with which a person can apply manual forces or other manually controlled forces to objects for manual cutting and auxiliary decoration. Normally, they are provided with handles facilitating carrying. Pliers are a type of common hand tools used for clamping, securing a workpiece or twisting, bending, shearing metal threads, among which the pliers used for clamping, securing a workpiece are also known as pincers or clamps.

A pincer or clamp is generally in V-shape, and usually formed by two clamp bodies with symmetrical shapes and structures which are partly superposed and secured by riveting. The clamp can flexibly open and close using its riveting joint as a pivot, which includes a lever principle, thereby transforming a smaller external force (such as a manual force applied to the clamp arms) into a larger clamping force at the clamp tip so that the clamp can clamp effectively.

Due to the absence of a mechanism locking the position of clamp arms in manual clamps in the prior art, the operator has to keep applying a larger force to the clamp when clamping an object until the clamping job is finished. This is both effort and time consuming, also the clamping is not steady. Regarding that, US Patent "Vise-Grip or Expanding Pliers" (U.S. Pat. No. 6,708,587B1) provides a technical solution using ratchet to lock the position of clamp arms, in which a member having ratchets is arranged on each of two clamp arms respectively, one of the members being stationary in relation to the clamp arm to which it is connected, the other of the members being rotatable in relation to the clamp arm to which it is connected, the ratchets on the two member being engaged with each other, the two sets of engaged ratchets being arranged so as to allow the movement of the two clamp arms toward each other rather than away from each other; and an actuating member is provided at the outside of one of the clamp arms (the side thereof away from the other clamp arm), in particular, a pushbutton that can automatically restore position; the actuating member is connected through a locking member to the member having ratchets and rotatable in relation to the clamp arms to which it is connected, so as to control whether the member having ratchets is engaged with the other member having ratchets.

When using the clamps, the locking member keeps the two sets of ratchets being engaged with each other and the two sets of ratchets can move in relation to each other when the user applies a pair of opposing forces to the two clamp arms (i.e. one clamp arm is subjected to a force in a direction pointing toward the other clamp arm), thereby allowing the two clamp arms to be movable toward each other, thus the two clamp tips are movable toward each other to hold the object to be clamped; when the object is clamped, the user withdraws the forces applied to the two clamp arms, and the locking member keeps the two sets of ratchets being engaged with each other, the two sets of ratchets being unmovable in relation to each other, thereby keeping the clamp tips in clamping state; when the user push down the actuating member and applies forces in opposite directions to the two clamp arms (i.e. one clamp arm is subjected to a force in a direction away from the other clamp arm), the locking member is opened and the clamping force is at least partly released, the two sets of ratchets no longer being engaged with each other, thereby allowing the two clamp arms to be movable in directions away from each other, thus the two clamp tips are movable away from each other to release the clamped object.

However, because the actuating member of the clamps of this prior art is arranged at the outside of one of the clamp arm, the user needs to push down the actuating member when releasing the clamped object. It is understood that when the user pushes down the actuating member, a force pointing toward the other clamp arm needs to be applied to the clamp arm where the actuating member is located, and the direction of the force is opposite to the direction of the forces applied to the hand gripping the clamp arms during the process of two actuations of the clamp arms, therefore, such operation is inconvenient and quite effort consuming.

Therefore, the person skilled in the field endeavors to develop a force relieving mechanism and a ratchet clamp having a force relieving mechanism to allow the user to operate conveniently and effort-savingly.

SUMMARY OF THE INVENTION

In view of the above defects residing in the prior art, the technical problem to be solved by the present invention is to provide a force relieving mechanism and a ratchet clamp having a force relieving mechanism, which allow the user to take advantage of engaged two sets of ratchets to lock the position of the clamp arm by arranging two sets of ratchets, an actuating member and a locking member, and to realize at least partly releasing the clamping force to the clamped object so as to conveniently and effort-savingly control the clamping and releasing of the object.

In order to achieve the above object, the present invention provides a force relieving mechanism, which is arranged on a tool and used for at least partly releasing a clamping force applied by the tool on an object, comprising a locking member, an actuating member, a first ratchet member having a first set of ratchets and a second ratchet member having a second set of ratchets, one end of the first ratchet member fixedly arranged on the tool, the second ratchet member coupled to the tool, the first set of ratchets engaged with the second set of ratchets, characterized in that, the second ratchet member is provided with a first hole comprising a first hole portion and a second hole portion; the locking member is arranged passing through in the first hole;

the actuating member connects the locking member, the actuating member applying a first actuation to the locking member; the first actuation causes the locking member to rotate from a first position to a second position in the first hole portion, the first ratchet member driving the second ratchet member by the first set of ratchets and the second set of ratchets that are engaged with each other, the locking member entering the second hole portion through the first hole portion, the clamping force at least partly released.

Further, after the first actuation, the actuating member also applies a second actuation to the locking member, the second actuation causing separation between the first set of ratchets and the second set of ratchets.

Further, the locking member comprises a first column of which the cross-section is an arch, the first column rotating in the first hole portion and the first column moving translationally in the second hole portion, a non-smoothly connected portion is provided between the first hole portion and the second hole portion.

Further, the non-smoothly connected portion is a step, the step is engaged against a curved sidewall portion of the first column to prevent the locking member from entering the second hole portion from the first hole portion when the first column is in the first position in the first hole portion; the step does not come into contact with the curved sidewall portion of the first column and the locking member is able to enter the second hole portion from the first hole portion when the first column is in the second position in the first hole portion.

Further, a first end of the actuating member connects the locking member so as to drive the locking member, the actuating member having a handle part extending from the first end thereof.

Further, the second ratchet member is provided with a blocking part, the blocking part protruding from the second ratchet member; the blocking part is arranged on a path of the handle part swinging toward an end part of the first ratchet member that is fixed to the tool.

Further, the mechanism also comprises a restoring member comprising a first elastic element arranged at the second hole portion, the first elastic element engaged against a sidewall of the first column.

Further, the first elastic element is a compression spring, one end of the compression spring engaged against the first column.

Further, the restoring member also comprises a second elastic element engaged against a sidewall of the handle part that is away from the blocking part.

Further, the second elastic element is a torsion spring, one end of the second elastic element engaged against the handle part.

Further, the tool is a clamp or a pincer.

The present invention also provides a ratchet clamp, used for clamping an object, comprising a first clamp arm, a second clamp arm, a locking member, an actuating member, a first ratchet member with a first set of ratchets and a second ratchet member with a second set of ratchets, the first clamp arm and the second clamp arm being rotatable around a first shaft connecting the first clamp arm and a first shaft of the second clamp arm; one end of the first ratchet member fixedly arranged on the first clamp arm, the second ratchet member coupled to the second clamp arm, the first set of ratchets engaged with the second set of ratchets, characterized in that, the second ratchet member is coupled to the second clamp arm by a second shaft provided on the second clamp arm, the second ratchet member being rotatable in relation to the first ratchet member;

the second ratchet member is provided with a first hole comprising a first hole portion and a second hole portion, the locking member is arranged passing through in the first hole;

the actuating member connects the locking member, the actuating member applying a first actuation to the locking member; the first actuation causes the locking member to rotate from a first position to a second position in the first hole portion, the first ratchet member driving the second ratchet member by the first set of ratchets and the second set of ratchets that are engaged with each other, the locking member entering the second hole portion through the first hole portion, the clamping force at least partly released.

Further, after the first actuation, the actuating member also applies a second actuation to the locking member, the second actuation causing separation between the first set of ratchets and the second set of ratchets.

Further, the locking member comprises a first column of which the cross-section is an arch, the first column rotating in the first hole portion and the first column moving translationally in the second hole portion, a non-smoothly connected portion is provided between the first hole portion and the second hole portion.

Further, the non-smoothly connected portion is a step, the step is engaged against a curved sidewall portion of the first column to prevent the locking member from entering the second hole portion from the first hole portion when the first column is in the first position in the first hole portion; the step does not come into contact with the curved sidewall portion of the first column and the locking member is able to enter the second hole portion from the first hole portion when the first column is in the second position in the first hole portion.

Further, the first set of ratchets and the second set of ratchets are arranged such that they are allowed to move toward each other and obstructed to move away from each other.

Further, a first end of the first ratchet member is fixed to the first clamp arm, a second end of the first ratchet member pointing toward the second clamp arm; a first end of the second ratchet member pointing toward the first clamp arm, the second end of the second ratchet member pointing toward the second clamp arm; the second set of ratchets starts from the first end of the second ratchet member to be distributed on the side part of the second ratchet member facing the first shaft; the first set of ratchets distributed on a side part of the first ratchet member away from the first shaft.

Further, a first end of the actuating member connects the locking member so as to drive the locking member, the actuating member having a handle part extending from the first end thereof.

Further, the second ratchet member is also provided with a blocking part, the blocking part being a portion protruding from the second ratchet member along a direction parallel to the first shaft; the blocking part is arranged on a path of the handle part swinging toward a first end of the first ratchet member.

Further, the clamp also comprises a restoring member comprising a first elastic element arranged at the second hole portion, the first elastic element engaged against a sidewall of the first column.

Further, the restoring member also comprises a second elastic element engaged against a sidewall of the handle part that is away from the blocking part.

Further, the first elastic element is a compression spring, one end of the compression spring engaged against the first column.

Further, the second elastic element is a torsion spring, a spring coil of the torsion spring surroundingly provided around the second shaft, one end of the second elastic element engaged against the handle part.

Further, the first end of the actuating member comprises a first wall and a second wall in parallel arrangement, the second ratchet member partly sandwiched between the first wall and second wall; the first end of the actuating member comprises a first pair of holes respectively on the first wall and the second wall, the locking member arranged passing through in the first pair of holes and not rotatable in the first pair of holes.

Further, the second ratchet member is arranged with an elongated second hole, the second shaft passing through the second hole and translationally movable in the second hole; the second hole is a closed hole or an open hole.

Further, the clamp also comprises a connecting member comprising a third wall and a fourth wall in parallel arrangement, a barrier wall connected between the third wall and the fourth wall; the second ratchet member partly sandwiched between the third wall and the fourth wall; the connecting member partly sandwiched between the first wall and the second wall; the barrier wall arranged on a path of the handle part swinging toward the second clamp arm.

Further, the locking member also comprises a second column adjacent to the first column, the second column being a cylinder; a third column connected between the third wall and the fourth wall, the third column longitudinally arranged in the second hole and being closer to the second clamp arm than the second shaft.

Further, the connecting member is provided with a second pair of holes fitting with the second shaft and a third pair of holes fitting with the locking member, the third pair of holes being respectively on the third wall and the fourth wall; the second shaft passing through the second pair of holes, the locking member passing through the third pair of holes and being rotatable in the third pair of holes.

Further, surfaces of the second ratchet member facing the third wall and the fourth wall are provided with a protruded portion coming into contact with the third wall and the fourth wall; the protruded portion being of elongated shape, extending along a direction of a movement of the second ratchet member in relation to the connecting member.

Further, one of the first pair of holes fits with the first column, the other one of the first pair of holes fitting with the second column; one of the second pair of hole fitting with the first column, the other one of the second pair of holes fitting with the second column; one of the third pair of holes fitting with the first column, the other one of the third pair of holes fitting with the second column.

In a preferred embodiment of the present invention, provided is a force relieving mechanism and a ratchet clamp having a force relieving mechanism, the first clamp arm and the second clamp arm are connected by a first shaft. A force relieving mechanism is arranged between the first clamp and the second clamp. The force relieving mechanism includes a first ratchet member, a second ratchet member, a locking member, an actuating member and a restoring member, in which, an end of the first ratchet member is fixedly connected to the first clamp arm, the other end pointing toward the second clamp arm, a first set of ratchets distributed on the side part thereof away from the first shaft; the second ratchet member is provided with a first hole including a circular first hole portion and an elongated second hole portion, and an elongated second hole. the opening of the second hole facing the open hole of the second clamp arm, the second shaft arranged on the second clamp arm passing through the second hole so that the second ratchet member is rotatable around the second shaft, the other end thereof pointing toward the first clamp arm, a second set of ratchets capable of fitting with the first set of ratchets being arranged thereon; the first set of ratchets and the second set of ratchets are arranged such that the first set of ratchets and the second set of ratchets allow the movement of the first clamp arm and the second clamp arm toward each other and obstruct that away from each other. The actuating member has a handle part extending from the first end of the actuating member in a direction away from the first shaft. Plate-shaped first and second wall in parallel arrangement are provided on the actuating member at the first end, a first pair of holes provided on the first wall and the second wall. The locking member includes a first column and a second column that are connected, in which the cross-section of first column is an arch, the first column passing through the first hole and rotatable in the first hole portion and translationally movable in the second hole portion. The locking member also passes through the first pair of holes of the first end of the actuation member, thereby the actuating member driving the locking member. The connecting member includes plate-shaped third and fourth walls in parallel arrangement, a third column and a barrier wall connected between the third wall and the fourth wall, the third wall and the fourth wall provided with a second pair of holes fitting with the second shaft and a third pair of holes fitting with the locking member. The second ratchet member is partly sandwiched between the third wall and the fourth wall, and the third column is longitudinally arranged in the second hole and outside the second shaft. The second ratchet member and the connecting member are partly sandwiched between the first wall and the second wall. The restoring member includes a first elastic element, which is a compression spring, arranged in the second hole portion of the first hole and engaged against a sidewall of the first column. The restoring member also includes a second elastic element, which is a torsion spring surroundingly provided around the second shaft, two end portion thereof engaged against the second clamp arm and the handle part, the second elastic element causing the actuating member to keep being engaged against the block part provided on the second ratchet member. When the user does not apply a force to the handle part toward the second clamp arm, the restoring member causes the first column to be kept in the first hole portion, where the second set of ratchets are kept in the state of being engaged with the first set of ratchets, and the first clamp tip portion and the second clamp tip portion of the ratchet clamp keep the clamping force applied to the object. When the use applies a large enough force to the handle part toward the second clamp arm, the actuating member applied a first actuation to the locking member, and the first column rotates in the first hole portion and continues to translationally move to the second hole portion, where the second set of ratchet are kept in the state of being engaged with the first set of ratchets, and the first clamp tip portion and the second clamp tip portion of the ratchet clamp release at least part of the clamping force applied to the object. When the user continues to apply a force to the handle part toward the second clamp arm, the actuating member applied a second actuation to the locking member, driving the second ratchet member to rotate around the second shaft, so that the second set of ratchets are detached from the first set of ratchets.

It is thus seen that the force relieving mechanism of the present invention realizes at least partly releasing the clamping force applied to the clamped object by arranging two sets of ratchets, an actuating member and a locking member. The ratchet clamp having a force relieving mechanism of the present invention utilizes a force relieving mechanism to cause the detachment of the engaged first and second sets of ratchets by two actuations applied to the locking member by the actuating member. In the first actuation, the two clamp tip portions of the ratchet clamp release at least part of the clamping force, and the ratchets engagement is still kept. In the second actuation, the engaged two sets of ratchets are detached. Thus it can be seen that due to the first actuation at least part of the clamping force is released, the acting force between the engaged two sets of ratchets is reduced, therefore, the operation for detaching the engaged two sets of ratchets in the second actuation can occur in a more smooth way, and causes less damage to the ratchets and protects the ratchets. In addition, due to the fact that the force relieving mechanism and the ratchet clamp having the force relieving mechanism as in the present invention are arranged between the first clamp arm and the second clamp arm, the direction of the force applied by the user to the actuating member is the same as the direction of the acting force applied by the second clamp arm to the hand gripping the second clamp arm in the two actuations when releasing the clamped object, such operation being convenient and effort-saving.

Referring now to the figures, the conception, detailed structure and induced technical effect of the present invention will be expounded for due understanding of the purpose, characterizations and effects of the present invention.

DETAILED DESCRIPTION OF THE PREFERRED EMBODIMENTS

Figure 1:
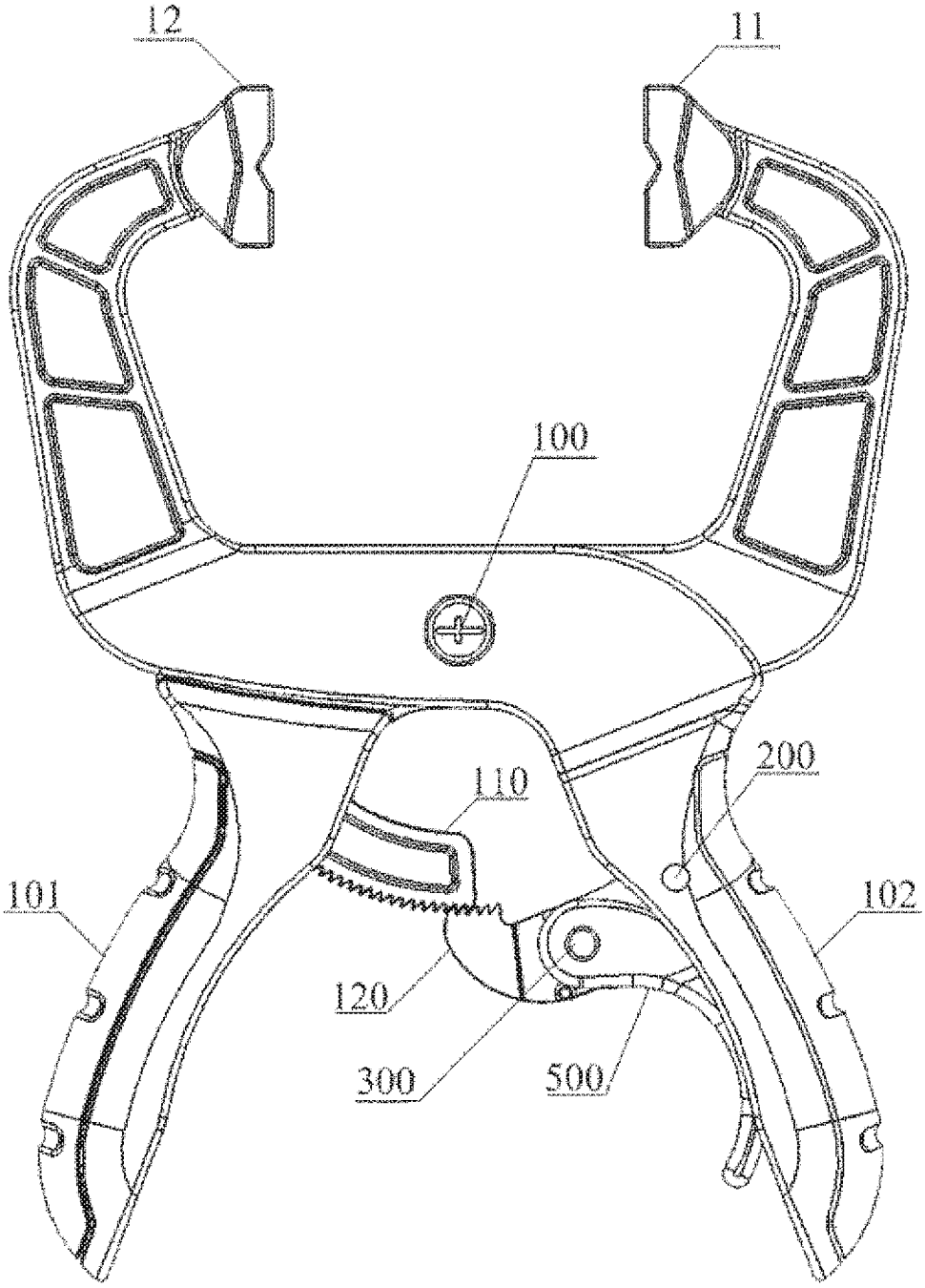
FIG. 1 is a front view of the ratchet clamp of the present invention in a preferred embodiment.
Figure 2:
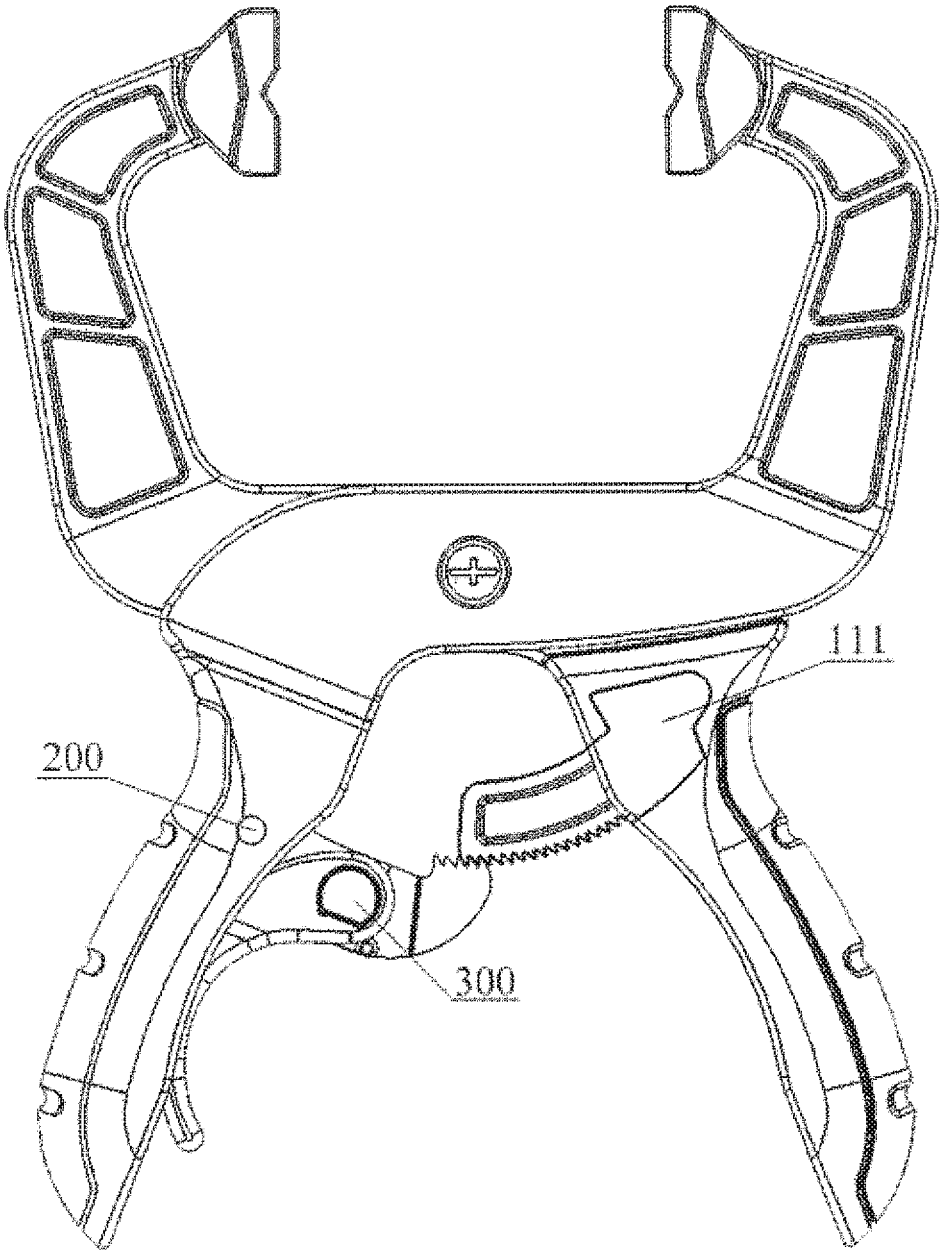
FIG. 2 is a back view of the ratchet clamp shown in FIG. 1.

FIGS. 1 and 2 show a ratchet clamp having a force relieving mechanism of the present invention in a preferred embodiment. A first clamp arm 101 and a second clamp arm 102 thereof are connected through a first shaft 100, and are rotatable about the first shaft 100 to control the closing or opening of a first clamp tip portion 11 and a second clamp tip portion 12. In particular, when the user applies forces to the first clamp arm 101 and the second clamp arm 102 to make them close in to each other (i.e. the first clamp arm 101 and the second clamp arm move toward each other), the first clamp tip portion 11 and the second clamp tip portion 12 also close in to each other, thereby clamping the object such as a workpiece; when the user applied forces to the first clamp arm 101 and the second clamp arm 102 to make them away from each other (i.e. the first clamp arm 101 and the second clamp arm 102 moves away from each other), the first clamp tip portion 11 and the second clamp tip portion 12 also moves away from each other, thereby releasing the workpiece.

Figure 3:
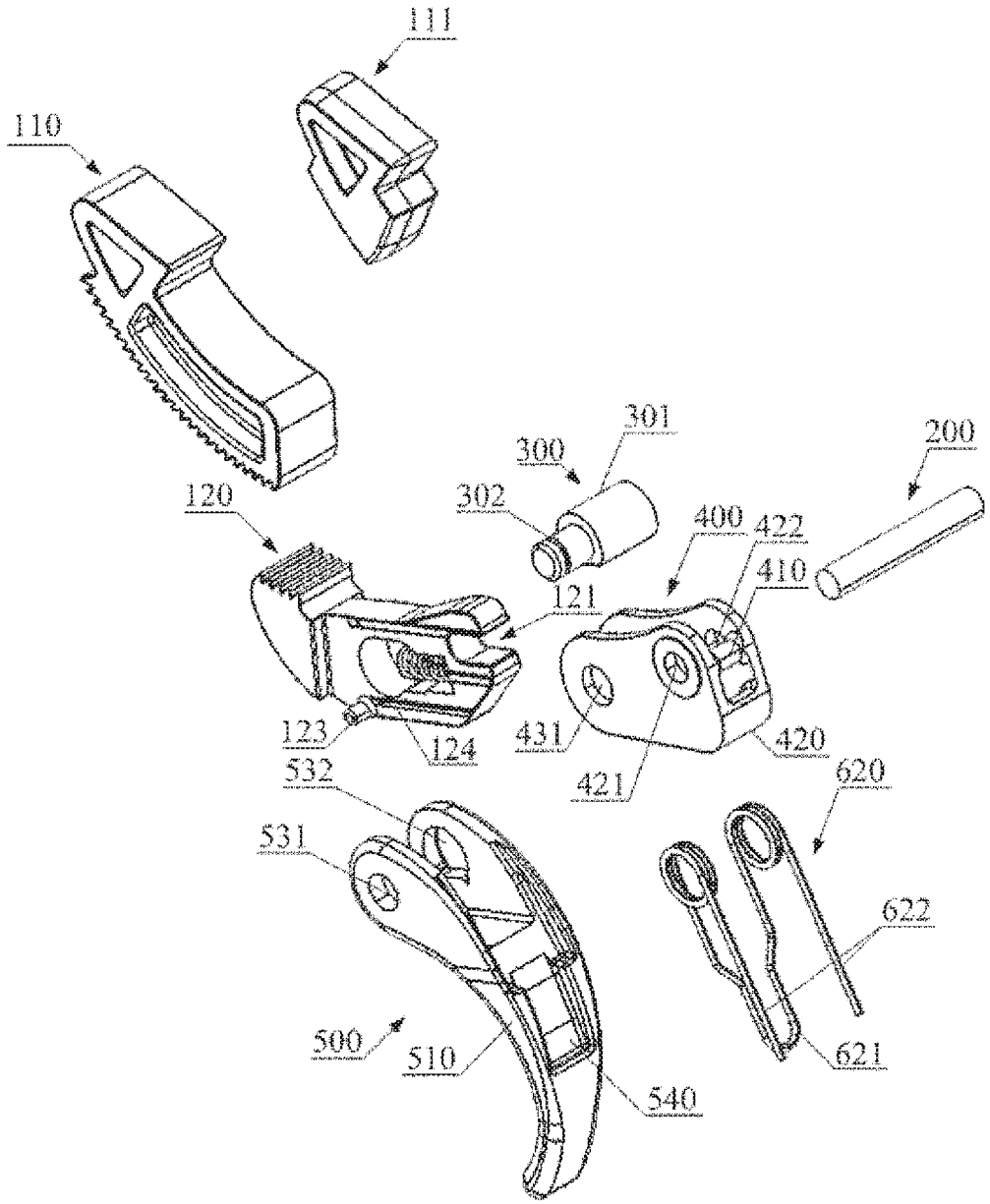
FIG. 3 shows an exploded structural view including a first ratchet member, a second ratchet member, a locking member, an actuating member and a restoring member of the ratchet clamp shown in FIG. 1.

A force relieving mechanism is arranged between the first clamp arm 101 and the second clamp arm 102, used for at least partly releasing the clamping force applied by the ratchet clamp to the workpiece when the ratchet clamp releases the workpiece. The force relieving mechanism includes a first ratchet member 110, a second ratchet member 120, a locking member 300, a connecting member 400, an actuating member 500 and a restoring member, and FIG. 3 shows the exploded structural view of them.

One end of the first ratchet member 110 is fixedly connected to the first clamp arm 101, and it is enabled to be more reliably fixedly connected to the first clamp arm 101 by an embedded member 111; the other end thereof is pointing toward the second clamp arm 102. A first set of ratchets are distributed on the side part of the first ratchet member 110 away from the first shaft 100.

An elongated second hole 121 is provided at one end of the second ratchet member 120. In the present embodiment, the second hole 121 is an open hole having an opening facing the second clamp arm 102. In other embodiments, the second hole 121 may also be a closed hole. A second shaft 200 arranged on the second clamp arm 102 longitudinally passing through the second hole 121. The extending direction of the second shaft 200 is the same as the first shaft 100, and, in the second hole 121, it is arranged perpendicular to the cross-section of the second hole 121 (perpendicular to the section of the first shaft, and the unspecified cross-sections in the present Specification all perpendicular to the section of the first shaft), thereby the second ratchet member 120 being rotatable about the second shaft 200. The second hole 121 is transversely arranged, thereby allowing the first ratchet member 110 to drive the second ratchet member 120 to move transversely by the engaged first and second sets of ratchets. The "transversely" in the Specification refers to along the direction extending from the first clamp arm 101 to the second clamp arm 102 or along the direction extending from the second clamp arm 102 to the first clamp arm 101.

The other end of the second ratchet member 120 points toward the first clamp arm 101. A second set of ratchets engaged with the first set of ratchets are distributed on the second ratchet member 120 at the side part toward the first shaft 100, and, preferably, the second set of ratchets starts distribution from the end of the second ratchet member 120 pointing toward the first clamp arm 101.

The tooth surfaces of each ratchets of the first set of ratchets and the second set of ratchets are arranged such that the movement of the first clamp arm 101 and the second clamp arm 102 toward each other is allowed while that away from each other is obstructed.

Figure 5:
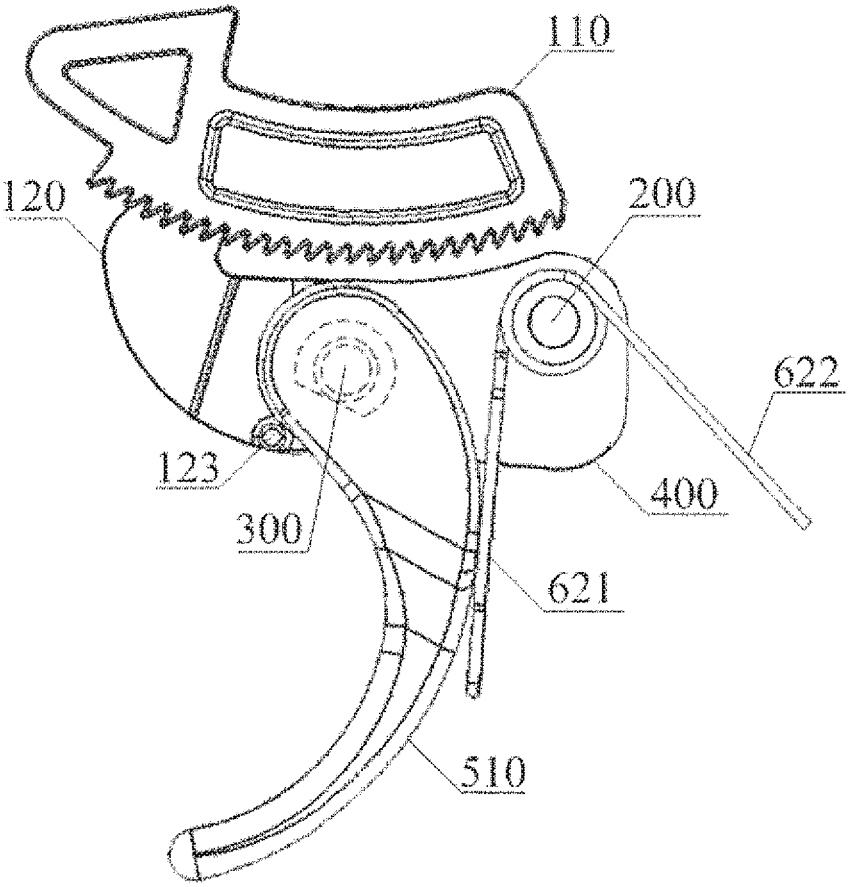
FIG. 5 shows the positional relationship of the first ratchet member, the second ratchet member, the locking member, the actuating member, a connecting member and the restoring member of the ratchet clamp shown in FIG. 1 when a force is not applied to the actuating member.

In the present embodiment, the locking member 300 includes a first column 301 and a second column 302 that are connected. The second column 302 is a cylinder, and the cross-section thereof is the first circle; the first column 301 is an incomplete cylinder, the cross-section thereof is an arch, the arc of the arch being a part of circumference of a circle which is a second circle. The arc length of the arch is larger than half of the circumference of the second circle. Preferably, the positional relationship of the first column 301 and the second column 302 is that the first circle and the second circle are arranged concentric on the cross-sections of them, as shown in FIG. 5. The locking member 300 may be integrally formed, and may also be formed by fixedly connecting the respectively formed first column 301 and second column 302.

Figure 4:
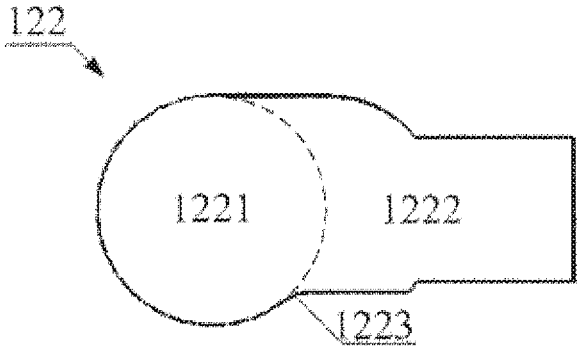
FIG. 4 shows the shape of the first hole of the second ratchet member, a cross-section thereof as shown.
Figure 6:
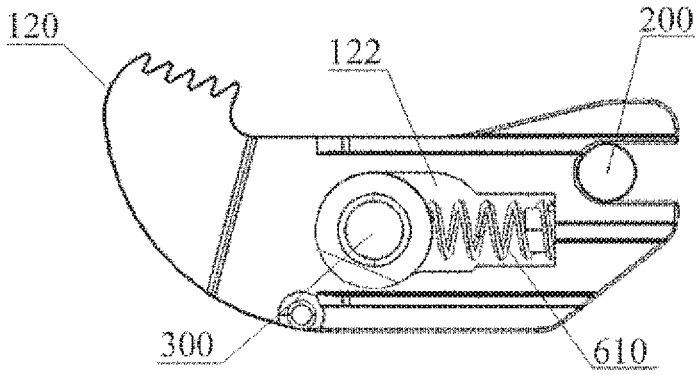
FIG. 6 shows the positional relationship of the second ratchet member, the locking member, a first elastic element and a second shaft shown in FIG. 5.
Figure 8:
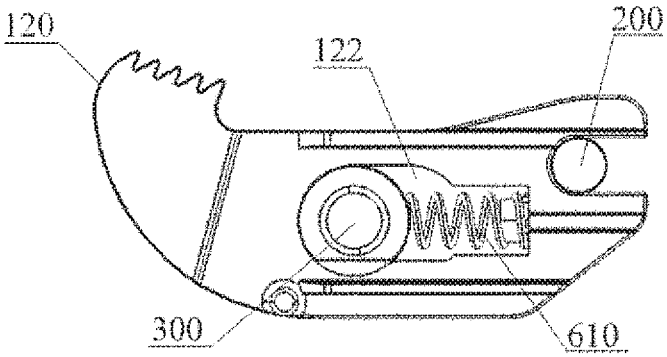
FIG. 8 shows the positional relationship of the second ratchet member, the locking member, the first elastic element and the second shaft shown in FIG. 7.

The first column 301 is arranged passing through in the first hole 122 of the second ratchet member 120, and is rotatable in the hole and is transversely movable when rotated to a certain angle. Preferably, the first hole 122 is arranged in the middle part of the second ratchet member 120, and FIG. 4 shows its cross-section. It can be seen in FIG. 4 that the first hole 122 includes a circular first hole portion 1221 and an irregular elongated second hole portion 1222; the first hole portion 1221 is adjacent to the first clamp arm 101, and the second hole portion 1222 is adjacent to the second clamp arm. A non-smoothly connected portion is provided between the two, which is a step 1223. The shape of the first hole 122 is arranged such that the first column 301 is rotatable but not translationally movable in the first hole portion 1221, and is translationally movable but not rotatable in the second hole portion 1223. Specifically, the step 1223 engages against the curved sidewall portion of the first column 301 when the first column 301 is in the first position (for example, the position as shown in FIG. 6) in the first hole portion 1221, thereby limiting the first column 301 in the first hole portion 1221, and the locking member 300 cannot move into the second hole portion 1222 from the first hole portion 1221; the step 1223 does not come into contact with the curved sidewall portion of the first column 301 when the first column 301 is in the second position (for example, the position as shown in FIG. 8) in the first hole portion 1221, thereby not limiting the movement of the first column 301, and the locking member 300 can move into the second hole portion 1222 from the first hole portion 1221.

The connecting member 400 is a slide block, which includes two plate-shaped walls (the third wall and the fourth wall) in parallel arrangement for containing part of the second ratchet member 120. A third column 410 and a barrier wall 420 are connected between the first wall and the fourth wall. Preferably, the third column 410 is a cylinder, which is perpendicular to the third wall and the fourth wall; the barrier wall 420 is a section of wall perpendicular to the third wall and the fourth wall. A second pair of holes 421, 422 for fitting with the second shaft 200 and a third pair of holes for fitting with the locking member 300 are provided on the third wall and the fourth wall, a hole 431 of the third pair of holes shown in FIG. 3 and the other hole not shown, in which, the hole 421 and the hole 431 are on the third wall, and the hole 422 and the other hole of the third pair of holes are on the fourth wall.

The second ratchet member 120 is sandwiched between the third wall and the fourth wall, and is slidable in relation to the connecting member 400. Preferably, the second ratchet member 120 has a protruded portion on each of the two surfaces thereof toward the third wall and the fourth wall, such as the protruded portion 124. These protruded portions protrude out from the above surfaces of the second ratchet member 120, used for coming into contact with the second ratchet member 120. They are of elongated shape, extending along the direction of the movement of the second ratchet member 120 in relation to the connecting member 400, thereby reducing the friction to which the second ratchet member 120 is subjected during the movement thereof in relation to the connecting member 400.

One end of the actuating member 500 is used for being engaged with the locking member 300. In the present embodiment, the end includes two plate-shaped walls (the first wall and the second wall) in parallel arrangement. A first pair of holes 531, 532 for fitting with the locking member 300 are provided on the first wall and the second wall, in which, the hole 531 is on the first wall and the hole 532 is on the second wall. The actuating member 500 also includes a portion extending along the direction from the above end away from the first shaft 100. In the present embodiment, the portion is a trigger-like handle portion 510 used for the user to apply force thereto to switch the engaged/separated state between the first set of ratchets and the second set of ratchets.

On the path of the handle part 510 swinging toward the first clamp arm 101, a blocking part 123 is arranged on the second ratchet member 120. In the present embodiment, the second ratchet member 120 is provided with two blocking parts, both of which are a portion protruding out of the second ratchet member 120 along the direction parallel to the first shaft. The blocking parts are used for limiting the degree of swing of the handle part 510 toward the first clamp arm 101. The barrier wall 420 of the connecting member 400 is arranged on the path of swing of the handle part toward the second clamp arm 102, used for limiting the degree of swing of the handle part 510 toward the second clamp arm 102.

The restoring member includes a first elastic element 610 (see FIG. 6) and a second elastic element 620. The first elastic element 610 is a compression spring, which is transversely arranged in the second hole portion 1222, one end of it being engaged against (i.e. contacting and compressing) the first column 301 of the locking member 300 so that the first column 301 is held in the first hole portion 1221. The second elastic element 620 is a torsion spring, the spring coil thereof being surroundingly arranged on the second shaft 200 and one end 621 thereof being engaged against the sidewall of the handle part 501 that is away from the second ratchets. Preferably, the sidewall is provided with a slot 540 fitting with the end part 621; the other end 622 engages against the inner wall of the second clamp arm 102. Due to being subjected to the engagement against it by the end part 621 of the second elastic element 620, the actuating member 500 keeps being engaged against the blocking part 123.

When assembling the second ratchet member 120, the locking member 300, the connecting member 400, the actuating member 500 and the restoring member, the second ratchet member 120 is partly sandwiched between the third wall and the fourth wall of the connecting member 400, and the third column 410 is arranged at the opening of the second hole 121 and thereby outside the second shaft (i.e. the side closer to the second clamp arm 102). The second ratchet member 120 and the connecting member 400 are partly sandwiched between the first wall and the second wall, and the locking member 300 is passed in turn through the hole 532, the other hole of the third pair of holes, the first hole 122, the hole 431 and the hole 531, in which, the first column 301 passes through the hole 532, the other hole of the third pair of holes and the first hole 122, the second column 302 passes through the hole 431 and the hole 531, and the locking member 300 cannot rotate in relation to the hole 532, the other hole of the third pair of holes, the first hole 122, the hole 431 and the hole 531. In addition, the second shaft 200 is passed in turn through one spring coil of the second elastic element 620, the hole 422, the second hole 121, the hole 421 and the other spring coil of the second elastic element 620.

Figure 7:
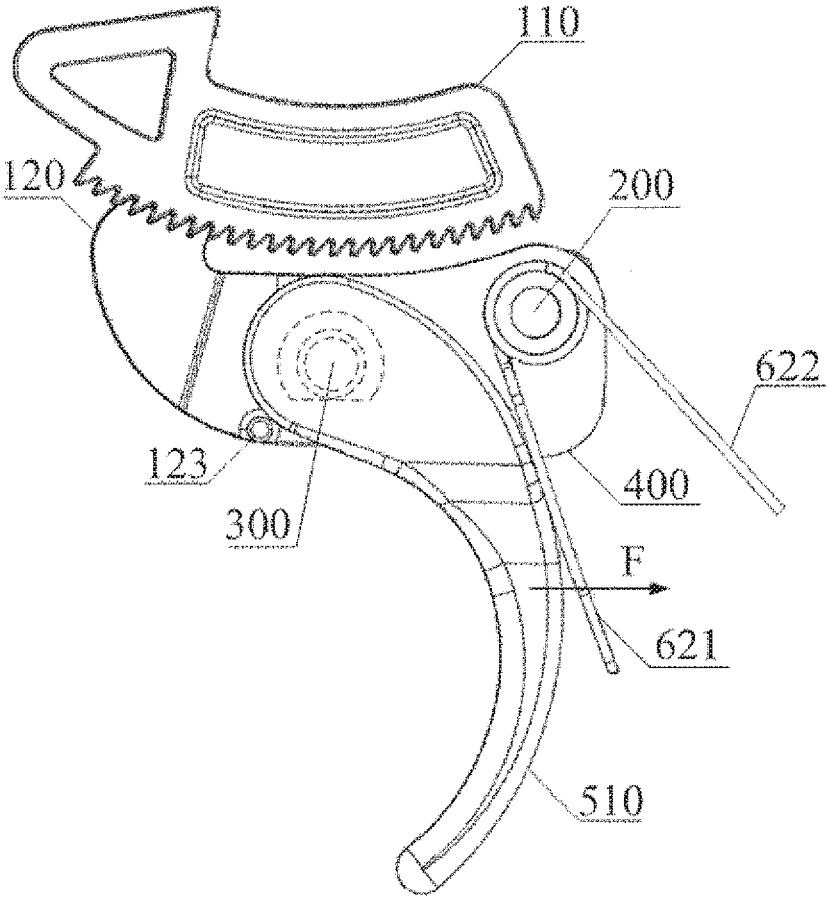
FIG. 7 shows the positional relationship of the first ratchet member, the second ratchet member, the locking member, the actuating member, the connecting member and the restoring member of the ratchet clamp shown in FIG. 1 after a force is applied to the actuating member to drive the locking member to rotate.
Figure 9:
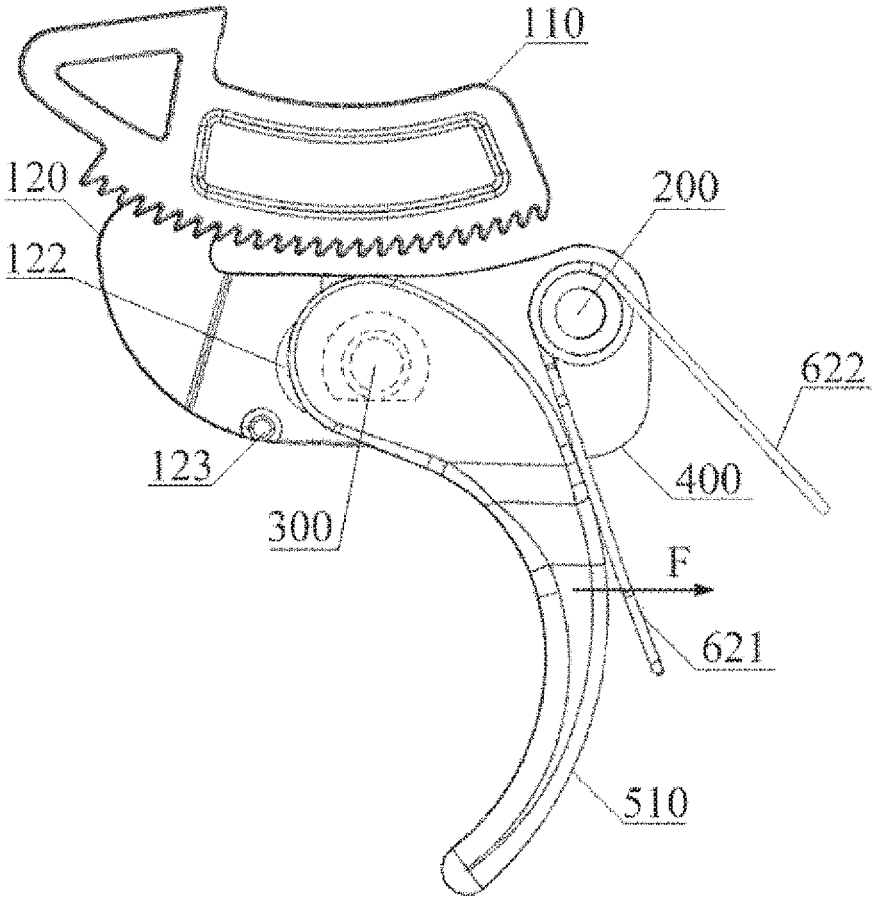
FIG. 9 shows the positional relationship of the first ratchet member, the second ratchet member, the locking member, the actuating member, the connecting member and the restoring member of the ratchet clamp shown in FIG. 1 after a force is applied to the actuating member to drive the locking member to move.
Figure 10:
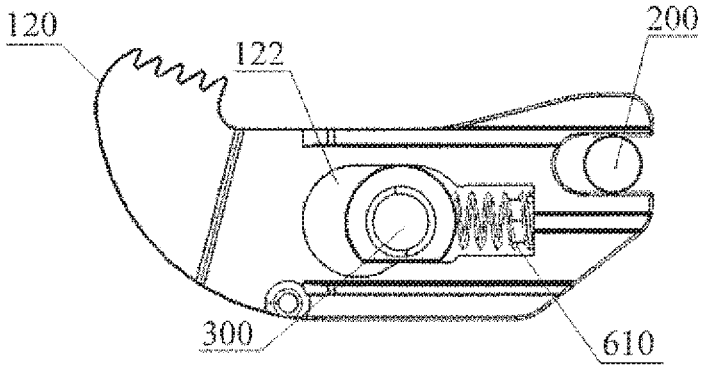
FIG. 10 shows the positional relationship of the second ratchet member, the locking member, the first elastic element and the second shaft shown in FIG. 9.

The two sets of ratchets of a ratchet clamp clamping the workpiece keep being engaged with each other, as shown in FIGS. 5, 6. When separating the engaged two sets of ratchets of the ratchet clamp clamping the workpiece, the actuating member 500 applies in turn to the locking member 300 a first actuation and a second actuation, in which the process of the first actuation (FIGS. 7-10) specifically is described as follows:

When the user applies a force F toward the second clamp arm to the handle part 510, as shown in FIG. 7, the actuating member 500 can conquer the friction and the restoring force of the second elastic element 620 and rotate, driving the locking member 300 and rotating it to the position as shown in FIGS. 7, 8. In the position, the first column 301 of the locking member 300 can pass over the step 1223 and enters the second hole portion 1222. Since the clamped workpiece is simultaneously applying a pair of forces in opposite directions away from each other to the first clamp arm 101 and the second clamp arm 102, the first clamp arm 101 and the second clamp arm 102 are enabled to have the tendency of moving away from each other, thereby the first clamp arm 101 driving the second ratchet member 120 by the first ratchet member 110; in relation to the second ratchet member 120, the locking member 300 will conquer the restoring force of the first elastic element 610 of the restoring member and moves from the first hole portion 1221 of the first hole 122 to the second hole portion 1222, as shown in FIGS. 9, 10. Thus, the distance between the first clamp tip portion 11 and the second clamp tip portion 12 will increase a little, releasing at least part of the clamping force applied to the clamped workpiece; the acting force between the engaged two sets of ratchets is correspondingly reduced.

Figure 11:
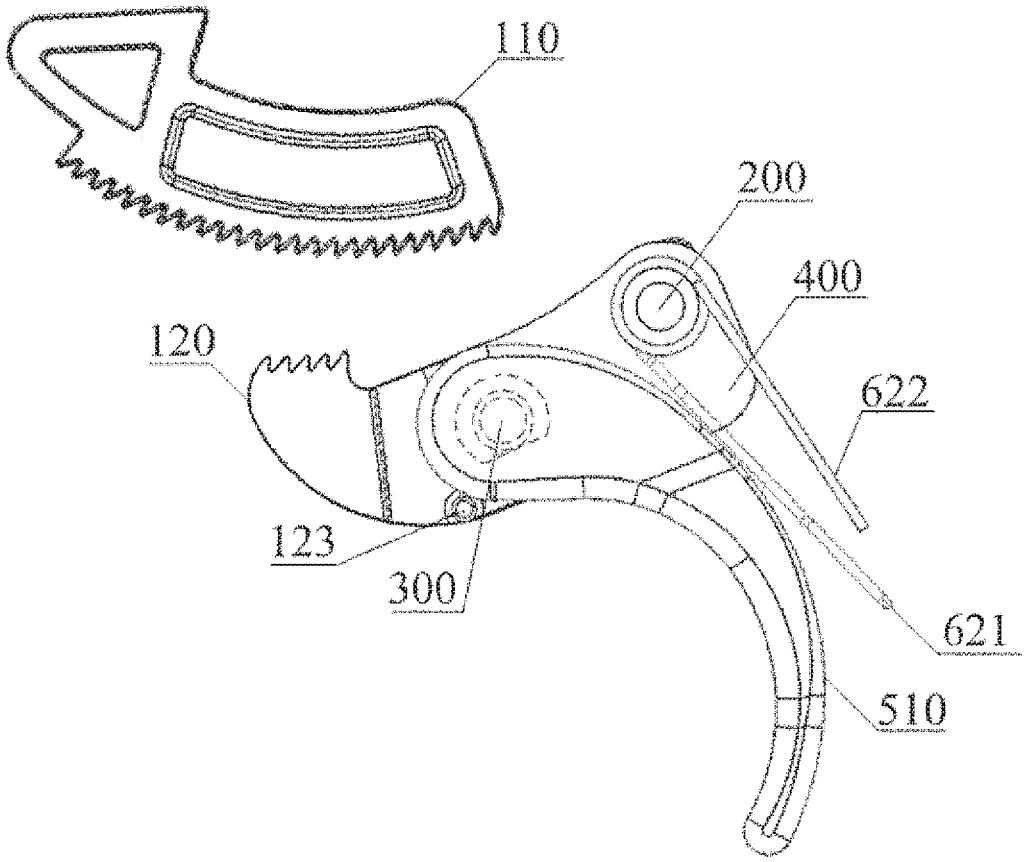
FIG. 11 shows the positional relationship of the first ratchet member, the second ratchet member, the locking member, the actuating member, the connecting member and the restoring member of the ratchet clamp shown in FIG. 1 after a force is applied to the actuating member and drives the locking member to rotate.
Figure 12:
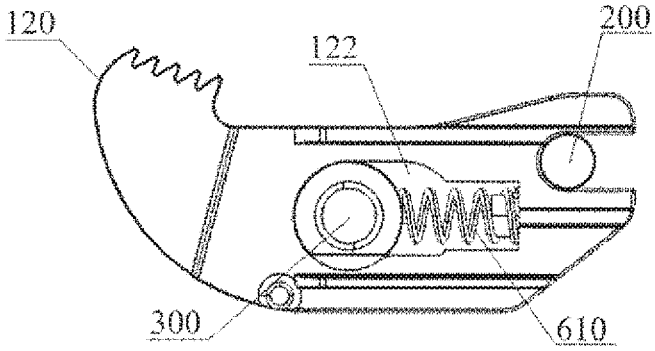
FIG. 12 shows the positional relationship of the second ratchet member, the locking member, the first elastic element and the second shaft shown in FIG. 11.

The process of the second actuation (FIGS. 11, 12) is specifically described as follows: the user continues to apply a force F toward the second clamp arm to the handle part 510. The actuating member 500 enables the second ratchet member 120 to rotate around the second shaft 200, so that the second set of ratchets is detached from the first set of ratchets. Because the detachment is processed when the acting force between the two sets of ratchets is rather small, it is more smooth and causing less damage to the ratchets. After the detachment of the second set of ratchets from the first set of ratchets, the restoring force of the first elastic element 610 of the restoring member will cause the second ratchet member 120 to have a small displacement in the direction toward the second clamp arm 102, so that the first column 301 of the locking member 300 is enabled to return to the first hole portion 1221, as shown in FIG. 12.

After the user withdraws the force F applied to the handle part 510, the restoring force of the second elastic element 620 causes the handle part 510 to rotate in the direction toward the second set of ratchets and engage against the blocking part 123. The handle part 510 drives the locking member 300 to rotate, causing the first column 301 of it to restore (the position as shown in FIGS. 5, 6), where the step 1223 causes the two sets of ratchets to keep being engaged with each other by the locking member 300.

The foregoing described the preferred embodiments of the present invention. It should be understood that an ordinary person skilled in the art can make many modifications and variations according to the concept of the present invention without creative work. Therefore, any person skilled in the art can get any technical solution through logical analyses, deductions and limited experiments, which should fall in the protection scope defined by the claims.

The invention claimed is:

1. A force relieving mechanism, which is arranged on a tool and used for at least partly releasing a clamping force applied by the tool to an object, comprising a locking member, an actuating member, a first ratchet member having a first set of ratchets and a second ratchet member having a second set of ratchets, one end of the first ratchet member fixedly arranged on the tool, the second ratchet member coupled to the tool, the first set of ratchets engaged with the second set of ratchets, characterized in that, the second ratchet member is provided with a first hole comprising a first hole portion and a second hole portion; the locking member being arranged passing through the first hole;

the actuating member connecting the locking member, the actuating member applying a first actuation to the locking member; the first actuation causing the locking member to rotate from a first position to a second position in the first hole portion, the first ratchet member driving the second ratchet member by the first set of ratchets and the second set of ratchets that are engaged with each other, the locking member entering the second hole portion through the first hole portion, the clamping force being at least partly released;

wherein the locking member comprises a first column whose cross-section is an arch, the first column rotating in the first hole portion and the first column moving translationally in the second hole portion, a non-smoothly connected portion being provided between the first hole portion and the second hole portion.

2. The force relieving mechanism according to claim 1, wherein, after the first actuation, the actuating member also applies a second actuation to the locking member, the second actuation causing separation between the first set of ratchets and the second set of ratchets.

3. The force relieving mechanism according to claim 1, wherein the non-smoothly connected portion is a step, when the first column is in the first position in the first hole portion, the step being engaged against a curved sidewall portion of the first column to prevent the locking member from entering the second hole portion from the first hole portion; when the first column is in the second position in the first hole portion, the step not coming into contact with the curved sidewall portion of the first column and the locking member being able to enter the second hole portion from the first hole portion.

4. The force relieving mechanism according to claim 1, wherein a first end of the actuating member connects the locking member so as to drive the locking member, the actuating member having a handle part extending from the first end thereof.

5. The force relieving mechanism according to claim 4, wherein the second ratchet member is provided with a blocking part, the blocking part protruding from the second ratchet member; the blocking part being arranged on a path of the handle part swinging toward an end part of the first ratchet member that is fixed to the tool.

6. The force relieving mechanism according to claim 5, wherein the mechanism also comprises a restoring member comprising a first elastic element arranged at the second hole portion, the first elastic element engaged against a sidewall of the first column; wherein the restoring member also comprises a second elastic element engaged against a sidewall of the handle part that is away from the blocking part.

7. A ratchet clamp, used for clamping an object, comprising a first clamp arm, a second clamp arm, a locking member, an actuating member, a first ratchet member having a first set of ratchets and a second ratchet member having a second set of ratchets, the first clamp arm and the second clamp arm being rotatable around a first shaft connecting the first clamp arm and the second clamp arm; one end of the first ratchet member fixedly arranged on the first clamp arm, the second ratchet member coupled to the second clamp arm, the first set of ratchets engaged with the second set of ratchets, characterized in that, the second ratchet member is coupled to the second clamp arm by a second shaft arranged on the second clamp arm, the second ratchet member being rotatable in relation to the first ratchet member;

the second ratchet member being provided with a first hole comprising a first hole portion and a second hole portion, the locking member being arranged passing through the first hole;

the actuating member connecting the locking member, the actuating member applying a first actuation to the locking member; the first actuation causing the locking member to rotate from a first position to a second position in the first hole portion, the first ratchet member driving the second ratchet member by the first set of ratchets and the second set of ratchets that are engaged with each other, the locking member entering the second hole portion through the first hole portion, a clamping force being at least partly released;

wherein the locking member comprises a first column whose cross-section is an arch, the first column rotating in the first hole portion and the first column moving translationally in the second hole portion, a non-smoothly connected portion being provided between the first hole portion and the second hole portion.

8. The ratchet clamp according to claim 7, wherein, after the first actuation, the actuating member also applies a second actuation to the locking member, the second actuation causing separation between the first set of ratchets and the second set of ratchets.

9. The ratchet clamp according to claim 7, wherein the non-smoothly connected portion is a step, when the first column is in the first position in the first hole portion, the step being engaged against a curved sidewall portion of the first column to prevent the locking member from entering the second hole portion from the first hole portion; when the first column is in the second position in the first hole portion, the step not coming into contact with the curved sidewall portion of the first column and the locking member being able to enter the second hole portion from the first hole portion.

10. The ratchet clamp according to claim 9, wherein the first set of ratchets and the second set of ratchets are arranged such that the first set of ratchets and the second set of ratchets allow a movement of the first clamp arm and the second clamp arm toward each other and obstruct the movement of the first clamp arm and the second clamp arm away from each other.

11. The ratchet clamp according to claim 10, wherein a first end of the first ratchet member is fixed to the first clamp arm, a second end of the first ratchet member pointing toward the second clamp arm; a first end of the second ratchet member pointing toward the first clamp arm, a second end of the second ratchet member pointing toward the second clamp arm; the second set of ratchets starting from the first end of the second ratchet member to be distributed on a side part of the second ratchet member toward the first shaft; the first set of ratchets distributed on a side part of the first ratchet member away from the first shaft.

12. The ratchet clamp according to claim 10, wherein a first end of the actuating member connects the locking member so as to drive the locking member, the actuating member having a handle part extending from the first end thereof.

13. The ratchet clamp according to claim 12, wherein the second ratchet member is also provided with a blocking part, the blocking part being a portion protruding from the second ratchet member along a direction parallel to the first shaft; the blocking part being arranged on a path of the handle part swinging toward a first end of the first ratchet member.

14. The ratchet clamp according to claim 13, wherein the clamp also comprises a restoring member comprising a first elastic element arranged at the second hole portion, the first elastic element engaged against a sidewall of the first column; wherein the restoring member also comprises a second elastic element engaged against a sidewall of the handle part that is away from the blocking part.

15. The ratchet clamp according to claim 14, wherein the first end of the actuating member comprises a first wall and a second wall in parallel arrangement, the second ratchet member partly sandwiched between the first wall and second wall; the first end of the actuating member comprising a first pair of holes respectively on the first wall and the second wall, the locking member arranged passing through the first pair of holes and not rotatable in the first pair of holes.

16. The ratchet clamp according to claim 15, wherein the clamp also comprises a connecting member comprising a third wall and a fourth wall in parallel arrangement, a barrier wall connected between the third wall and the fourth wall; the second ratchet member partly sandwiched between the third wall and the fourth wall; the connecting member partly sandwiched between the first wall and the second wall; the barrier wall arranged on a path of the handle part swinging toward the second clamp arm.

17. The ratchet clamp according to claim 16, wherein the locking member also comprises a second column adjacent to the first column, the second column being a cylinder; a third column connected between the third wall and the fourth wall, the third column longitudinally arranged in the second hole and being closer to the second clamp arm than the second shaft.

18. The ratchet clamp according to claim 17, wherein the connecting member is provided with a second pair of holes fitting with the second shaft and a third pair of holes fitting with the locking member, the third pair of holes being respectively on the third wall and the fourth wall; the second shaft passing through the second pair of holes, the locking member passing through the third pair of holes and being rotatable in the third pair of holes.

* * * * *